United States Patent [19]

Santambrogio et al.

[11] Patent Number: 4,692,170

[45] Date of Patent: Sep. 8, 1987

[54] CHEMICAL COMPOUNDS TO BE USED AS SOLID CARRIERS FOR FUEL ADDITIVES

[75] Inventors: Alberto Santambrogio, Corsico; Luciano Mattei, Milan, both of Italy

[73] Assignee: Agip Petroli, S.p.A., Rome, Italy

[21] Appl. No.: 556,137

[22] Filed: Nov. 29, 1983

[30] Foreign Application Priority Data

Dec. 2, 1982 [IT] Italy ..... 24561 A/82

[51] Int. Cl.[4] ..... C10L 1/18; C10L 1/22

[52] U.S. Cl. ..... 44/63; 44/77; 44/78

[58] Field of Search ..... 546/166; 524/87; 44/78, 44/77, 4, 6; 252/10, 63

[56] References Cited

U.S. PATENT DOCUMENTS

| | | | |
|---|---|---|---|
| 2,100,998 | 11/1937 | Sibley | 524/87 |
| 2,275,175 | 3/1942 | Cloud | 44/78 |
| 2,387,920 | 10/1945 | Lowry, Jr. | 44/78 |
| 2,394,978 | 2/1946 | Brandon | 44/78 |
| 3,305,522 | 2/1967 | Spacht | 44/78 |
| 4,549,884 | 10/1985 | Maurae | 44/78 |

*Primary Examiner*—Jacqueline V. Howard

*Attorney, Agent, or Firm*—Morgan & Finnegan

[57] ABSTRACT

Chemical compounds, having a melting point between 70° C. and 130° C. and soluble in hydrocarbons, are used as solid carriers in order to dose conveniently additives for fuels for internal combustion engines. The compounds are selected from the group consisting of alkyl-substituted phenols, aromatic carbonates, alkyl-substituted pyrocatechols, polymers of alkyl-substituted 1,2-dihydroquinoline.

6 Claims, No Drawings

CHEMICAL COMPOUNDS TO BE USED AS SOLID CARRIERS FOR FUEL ADDITIVES

This invention relates to hydrocarbon-soluble chemical compounds to be used as solid carriers of additives for fuels.

Such additives, already known in the trade, are liquid at room temperature and are used for any kind of internal-combustion engines. For example, in the case of gasolines (petrols) such additives are intended, inter-alia, to reduce emissions, to keep carburetors clean and to prevent rust formation.

The compounds according to the present invention can be used as carriers, in the form of tablets, for any additive whatsoever of the kind referred to above and have the particular feature of being soluble in the fuel without originating or causing effects which are undesirable from the standpoints of combustion and toxicity.

A tablet, consisting of the carrier and the additive, is added directly in the fuel tank of a car in a preselected ratio relative to the quantity of fuel which is charged. This facilitates the dosing of additives.

The chemical compounds which can be used, according to this invention, as solid carriers for fuel additives, belong to the following classes:

alkyl-substituted phenols, 2,6-di-tert.butyl-p-cresol and and 2,4,6-tri-tert.butyl phenol being preferred;

aromatic carbonates, more particularly biphenylcarbonate;

alkyl-substituted pyrocatechols, more particularly 3,5-di-tert.butyl-pyrocatechol, and polymers of alkyl substituted 1,2-dihydroquinoline, and more particularly 2,2,4-trimethyl-1,2-dihydroquinoline, a polymer having a melting point between 75° C. and 85° C.

The chemical compounds of which the carriers are made, in accordance with this invention, having a melting point between 70° C. and 130° C., thus ensuring the integrity of the tablets under rather severe storage conditions, such as in a motor car in summertime.

The chemical compounds of which the carriers are made in accordance with the invention have satisfactory properties with respect to solubility in fuels, low or non-existent toxicity levels and tabletting ease, so that the tablets do not crumble even when stirred, that is to say, under the conditions which are present in the fuel tanks of a running motor car. The dust being formed from a crumbling tablet would, if the time of dissolution of the solid carrier in the fuel were too long, clog the carburettor nozzle so that carburation would consequently be defective.

In a few cases, such as for 2,6-di.tert.butyl-p.cresol, 2,3,6-tert.butylphenol or the polymers of 2,2,4-trimethyl-1,2-dihydroquinoline, the chemical compounds employed as carriers, according to the present invention, have antioxidizing properties. This is an asset over various different useful carriers which are inert in this respect.

The following Table reports the essential properties of a few of the compounds which can be used as carriers according to this invention and is not limited.

The preparation of the tablets containing the carrier and the additive according to the invention can be carried out by conventional procedures. The tablets contain the solid carrier in an amount corresponding to 90%–94% and the commercial additives in an amount of from 6% to 10% on a weight basis and can be added to the fuel directly by the user.

TABLE

| Product | Chemical Formula | Melting Point °C. | Tablet compactness | Time of dissolution in gasoline (petrol) at rest | Time of dissolution in gasoline (petrol) with a shock-producing device |
|---|---|---|---|---|---|
| 2,6-di-tert butyl-p-cresol | 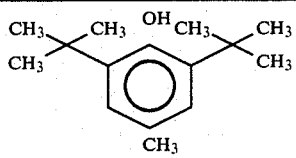 | 71 | very good | 9 min 10 sec | 1 min 50 sec |
| ANOX HB (2,2,4-trimethyl-1,2 dihydroquinoline polymer) | 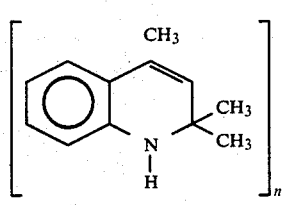 | 75 ÷ 85 | good | 66 min | 8 min 40 sec |
| Biphenylcarbonate | 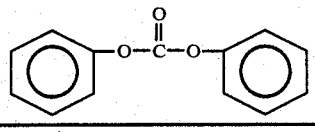 | 78 | good | 180 min | 11 min 30 sec |

For the determination of the dissolution times under at rest conditions, as reported in the Table, the tablet was added to a fixed volume of gasoline (petrol) contained in a stoppered flask and, without stirring, the time for the entire tablet to dissolve was noted.

Both for this test and for the test with stirring, a concentration of tablets was used which was about 10 times the concentration as actually used in practice, in order to better investigate the relative solubility of the several carriers and to observe phenomena which, in the usually employed concentrations, might have escaped detection.

For determining the dissolution times with stirring, after having added the tablet to gasoline (petrol), the flask was placed on a shaker.

During dissolution, the flask was checked to see if the tablet remained whole to the end of the test or if it crumbled.

It is to be noted that the times of dissolution with stirring are much closer to each other than the times of dissolution under undisturbed conditions.

A few examples are reported hereinafter to illustrate the preparation of tablets with additives, using carrier compounds according to the invention, it being understood that the invention is by no means restricted thereto.

EXAMPLE 1

1350 Kg. of 2,6-di.tert.butyl-p.cresol and 150 Kg of the additive DMA-4 manufactured by DuPont were placed in a stainless steel container having a volume of 2,500 liters and fitted with a heating jacket.

The mixture was heated to 80° C. with stirring until a homogeneous solution was obtained. The mixture is allowed to cool at room temperature and 7-gram tablets were prepared, containing 0.7 g. of additive each, to be used in an amount of one tablet per 15 liters of gasoline (petrol).

EXAMPLE 2

1410 Kg. of 2,6-di.tert.butyl-p.cresol and 90 Kg. of multifunctional MPA-447-R additive manufactured by the Ethyl Corporation were heated with stirring in a stainless steel vessel until the entire solid carrier was melted, which took place at a temperature of about 80° C.

After having prepared a homogeneous solution, the mass was cooled in bulk at room temperature and, by known procedures, 5 g. tablets were prepared, each containing 0.3 g of additive, to be used in the proportion of 1 tablet per 15 liters gasoline (petrol).

EXAMPLE 3

1350 Kg. of 2,6-di.tert.butyl-p.cresol and 150 Kg. of Lubrizol-580 additive manufactured by the Lubrizol Corporation were heated in a reactor with stirring until the solid carrier melted completely, which occurred by heating the reactor up to about 80° C.

After cooling the mass in bulk, there were prepared, quite conventionally, 10 g. tablets, each containing 1 g of additive, to be used in the proportion of 1 tablet per 10 liters of gasoline (petrol).

We claim:

1. Compositions of dosing additives to fuel for internal combustion engines, comprising (1) solid carrier chemical compounds, which have a melting point between 70° C. and 130° C., are soluble in hydrocarbons and are selected from the group consisting of alkyl-substituted phenols, aromatic carbonates, alkyl-substituted pyrocatechols, and polymers of alkyl-substituted 1,2-dihydroquinoline; and (2) additives for fuel for internal combustion engines which are liquid at room temperature.

2. A composition according to claim 1 wherein the solid carrier chemical compound is 1,6-di.tert.butyl-p.cresol.

3. A composition according to claim 1 wherein the solid carrier chemical compound is 2,4,6-tri.-tert.butylphenol.

4. A composition according to claim 1 wherein the solid carrier chemical compound is biphenylcarbonate.

5. A composition according to claim 1 wherein the solid carrier chemical compound is 3,5-di.tert.butylpyrocatechol.

6. A composition according to claim 1 wherein the solid carrier chemical compound is 2,2,4-trimethyl-1,2-dihydroquinoline polymer having a melting point between 75° C. and 85° C.

* * * * *